US006635169B1

(12) United States Patent
Bhore et al.

(10) Patent No.: US 6,635,169 B1
(45) Date of Patent: Oct. 21, 2003

(54) METHOD FOR REDUCING GASOLINE SULFUR IN FLUID CATALYTIC CRACKING

(75) Inventors: Nazeer A. Bhore, Bryn Mawr, PA (US); Arthur W. Chester, Cherry Hill, NJ (US); Ke Liu, East Long Meadow, MA (US); Hye Kyung Cho Timken, Woodbury, NJ (US)

(73) Assignees: Mobil Oil Corporation, Fairfax, VA (US); W. R. Grace & Co.-Conn, Columbia, MD (US)

( * ) Notice: Subject to any disclaimer, the term of this patent is extended or adjusted under 35 U.S.C. 154(b) by 0 days.

(21) Appl. No.: 09/399,637

(22) Filed: Sep. 20, 1999

(51) Int. Cl.[7] ..... C10G 11/02; C10G 11/05

(52) U.S. Cl. ..... 208/120.2; 208/120.01; 208/120.05; 208/120.1; 208/120.35; 208/120.25; 208/243; 208/247; 208/248; 208/249

(58) Field of Search ..... 208/243, 247, 208/248, 249, 120.01, 120.05, 120.1, 120.35, 120.25, 120.2

(56) References Cited

U.S. PATENT DOCUMENTS

| | | | | | |
|---|---|---|---|---|---|
| 2,417,275 | A | | 3/1947 | Thompson et al. | 252/242 |
| 3,873,470 | A | | 3/1975 | Conway et al. | 252/465 |
| 3,926,778 | A | | 12/1975 | Owen et al. | 208/74 |
| 4,115,252 | A | | 9/1978 | Antos | 208/139 |
| 4,153,535 | A | | 5/1979 | Vasalos et al. | 208/120 |
| 4,298,460 | A | | 11/1981 | Fujimori et al. | 208/121 |
| 4,337,144 | A | | 6/1982 | Yoo | 208/120 |
| 4,432,890 | A | * | 2/1984 | Beck et al. | 502/62 |
| 4,497,903 | A | | 2/1985 | Kibby et al. | 502/85 |
| 4,507,397 | A | | 3/1985 | Buss | 502/38 |
| 4,588,702 | A | * | 5/1986 | Beck et al. | 502/65 |
| 4,690,806 | A | * | 9/1987 | Schorfheide | 423/230 |
| 4,735,705 | A | * | 4/1988 | Burk, Jr. et al. | 208/113 |
| 4,794,095 | A | | 12/1988 | Walker et al. | 502/64 |
| 4,832,921 | A | | 5/1989 | Greenwood | 422/223 |
| 4,834,867 | A | * | 5/1989 | Gilson | 208/120 |
| 4,846,960 | A | | 7/1989 | Walker et al. | 208/119 |
| 4,859,643 | A | | 8/1989 | Sechrist et al. | 502/37 |
| 4,929,337 | A | * | 5/1990 | Herbst et al. | 208/120 |
| 4,944,864 | A | * | 7/1990 | Kugler | 208/120 |
| 4,980,051 | A | * | 12/1990 | Owen | 208/113 |
| 5,045,176 | A | | 9/1991 | Walters et al. | 208/113 |
| 5,104,519 | A | | 4/1992 | Haddad et al. | 208/152 |
| 5,108,968 | A | | 4/1992 | Ellingham et al. | 502/43 |
| 5,198,397 | A | | 3/1993 | Raterman | 502/43 |
| 5,260,240 | A | * | 11/1993 | Guthrie et al. | 502/41 |
| 5,275,990 | A | | 1/1994 | Clark et al. | 502/43 |
| 5,376,608 | A | | 12/1994 | Wormsbecher et al. | 502/61 |
| 5,399,327 | A | | 3/1995 | Kim | 423/244.11 |
| 5,401,391 | A | * | 3/1995 | Collins et al. | 208/208 R |
| 5,482,617 | A | * | 1/1996 | Collins et al. | 208/227 |
| 5,525,210 | A | | 6/1996 | Wormsbecher et al. | 208/122 |
| 5,591,419 | A | | 1/1997 | Mcmanus et al. | 423/576.6 |
| 5,597,537 | A | | 1/1997 | Wegerer et al. | 422/144 |
| 5,599,439 | A | | 2/1997 | Collins et al. | 208/89 |
| 5,618,406 | A | | 4/1997 | Dimmel | 208/48 |
| 5,693,582 | A | | 12/1997 | Vuitel et al. | 502/41 |
| 5,723,039 | A | | 3/1998 | Zosimov et al. | 205/696 |
| 5,843,382 | A | | 12/1998 | Rehmat | 422/170 |
| 5,854,161 | A | | 12/1998 | Ichiki et al. | 502/41 |
| 5,880,050 | A | | 3/1999 | Boitiaux et al. | 502/53 |
| 5,965,474 | A | * | 10/1999 | Balko et al. | 502/65 |

FOREIGN PATENT DOCUMENTS

| | | |
|---|---|---|
| GB | 2 341 191 A | 3/2000 |
| GB | 2 345 293 A | 7/2000 |

* cited by examiner

*Primary Examiner*—Nadine G. Norton
(74) *Attorney, Agent, or Firm*—W.R. Grace & Co.-Conn.; Charles A. Cross

(57) ABSTRACT

The sulfur content of liquid cracking products, especially the cracked gasoline, of a catalytic cracking process is reduced by the use of a catalyst having a product sulfur reduction component containing a metal component in an oxidation state greater than zero, wherein the average oxidation state of the metal component is increased by an oxidation step following conventional catalyst regeneration. The catalyst is normally a molecular sieve such as a zeolite Y, REY, USY, REUSY, Beta or ZSM-5. The metal component is normally a metal of Groups 5, 7, 8, 9, 12 or 13 of the periodic table, preferably vanadium or zinc. The sulfur reduction component may be a separate particle additive or part of an integrated cracking/sulfur reduction catalyst. A system for increasing the oxidation state of the metal component of a Gasoline Sulfur Reduction additive is also provided.

7 Claims, 1 Drawing Sheet

METHOD FOR REDUCING GASOLINE SULFUR IN FLUID CATALYTIC CRACKING

BACKGROUND OF THE INVENTION

Figure 1:
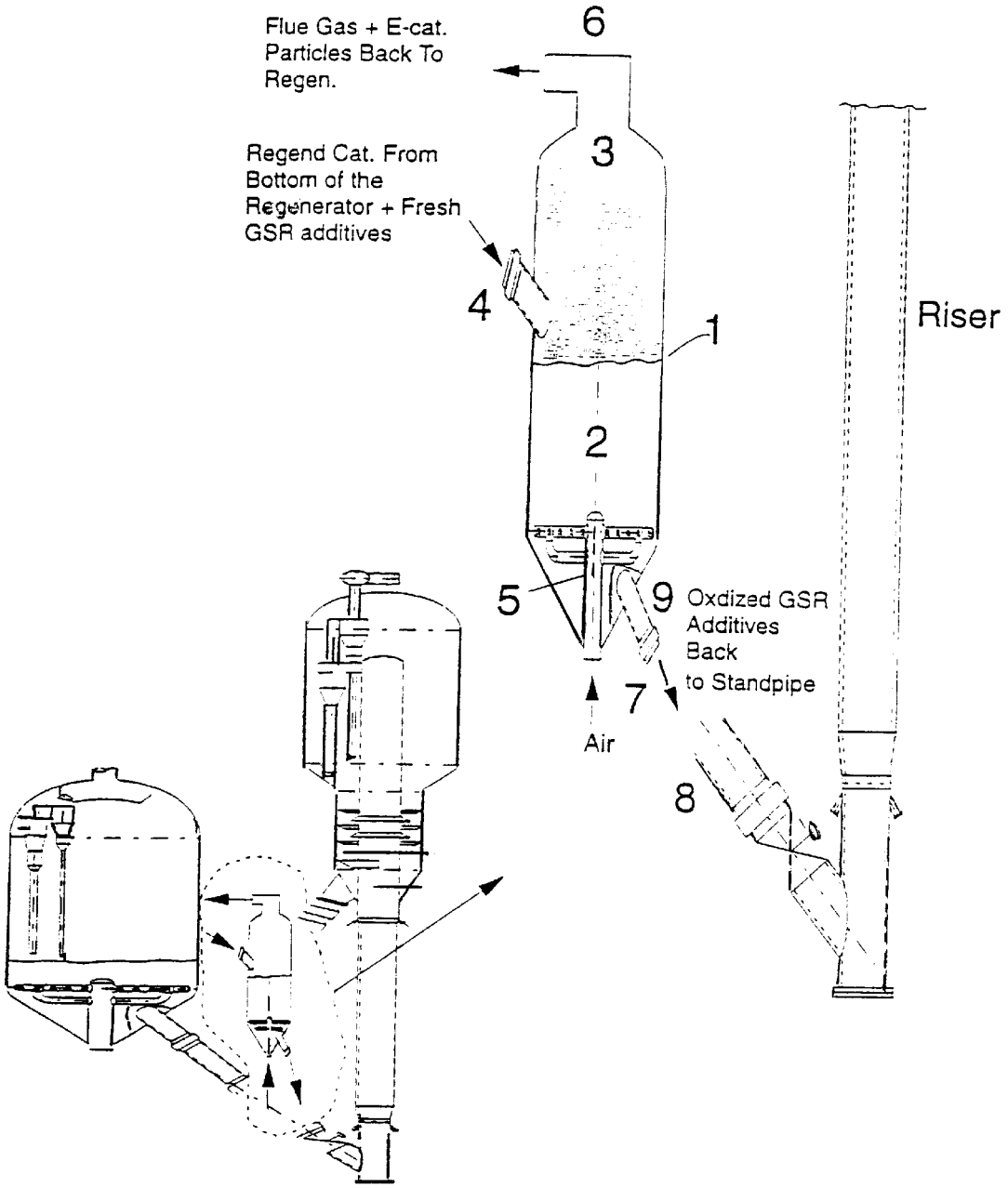

This invention relates to the reduction of sulfur in gasoline and other petroleum products produced by the catalytic cracking process. In particular, the invention relates to an improved method which employs catalytic compositions for reducing product sulfur content.

Catalytic cracking is a petroleum refining process which is applied commercially on a very large scale, especially in the United States where the majority of the refinery gasoline blending pool is produced by catalytic cracking, with almost all of this coming from the fluid catalytic cracking (FCC) process. In the catalytic cracking process, heavy hydrocarbon fractions are converted into lighter products by reactions taking place at elevated temperature in the presence of a catalyst, with the majority of the conversion or cracking occurring in the vapor phase. The feedstock is converted into gasoline, distillate and other liquid cracking products as well as lighter gaseous cracking products of four or less carbon atoms per molecule. The gas partly consists of olefins and partly of saturated hydrocarbons.

During the cracking reactions some heavy material, known as coke, is deposited onto the catalyst. This reduces its catalytic activity and regeneration is desired. After removal of occluded hydrocarbons from the spent cracking catalyst, regeneration is accomplished by burning off the coke to restore the catalyst activity. The three characteristic steps of a typical catalytic cracking process can be identified as follows: a cracking step in which the hydrocarbons are converted into lighter products, a stripping step to remove hydrocarbons adsorbed on the catalyst and a regeneration step to burn off coke from the catalyst. The regenerated catalyst is then reused in the cracking step.

Catalytic cracking feedstocks normally contain sulfur in the form of organic sulfur compounds such as mercaptans, sulfides and thiophenes. The products of the cracking process correspondingly tend to contain sulfur impurities even though about half of the sulfur is converted to hydrogen sulfide during the cracking process, mainly by catalytic decomposition of non-thiophenic sulfur compounds. Although the amount and type of sulfur in the cracking products are influenced by the feed, catalyst type, additives present, conversion and other operating conditions, a significant portion of the sulfur generally remains in the product pool. With increasing environmental regulation being applied to petroleum products, for example in the Reformulated Gasoline (RFG) regulations, the allowable sulfur content of the products has generally been decreased in response to concerns about the emissions of sulfur oxides and other sulfur compounds into the air following combustion processes.

One approach has been to remove the sulfur from the FCC feed by hydrotreating before cracking is initiated. While highly effective, this approach tends to be expensive in terms of the capital cost of the equipment as well as operationally since hydrogen consumption is high. Another approach has been to remove the sulfur from the cracked products by hydrotreating. Again, while effective, this solution has the drawback that valuable product octane may be lost when the high octane olefins are saturated.

From an economic point of view, it would be desirable to achieve sulfur removal in the cracking process itself since this would effectively desulfurize the major component of the gasoline blending pool without additional treatment. Various catalytic materials have been developed for the removal of sulfur during the FCC process cycle but, so far, most developments have centered on the removal of sulfur from the regenerator stack gases. An early approach developed by Chevron used alumina compounds as additives to the inventory of cracking catalyst to adsorb sulfur oxides in the FCC regenerator; the adsorbed sulfur compounds which entered the process in the feed were released as hydrogen sulfide during the cracking portion of the cycle and passed to the product recovery section of the unit where they were removed. See Krishna et al, *Additives Improve FCC Process*, Hydrocarbon Processing, November 1991, pages 59–66. The sulfur is removed from the stack gases from the regenerator but product sulfur levels are not greatly affected, if at all.

An alternative technology for the removal of sulfur oxides from regenerator removal is based on the use of magnesium-aluminum spinels as additives to the circulating catalyst inventory in the FCCU. Under the designation DESOX™ used for the additives in this process, the technology has achieved a notable commercial success. Exemplary patents on this type of sulfur removal additive include U.S. Pat. Nos. 4,963,520; 4,957,892; 4,957,718; 4,790,982 and others. Again, however, product sulfur levels are not greatly reduced.

A catalyst additive for the reduction of sulfur levels in the liquid cracking products is proposed by Wormsbecher and Kim in U.S. Pat. Nos. 5,376,608 and 5,525,210, using a cracking catalyst additive of an alumina-supported Lewis acid for the production of reduced-sulfur gasoline but this system has not achieved significant commercial success. The need for an effective additive for reducing the sulfur content of liquid catalytic cracking products has therefore persisted.

In application Ser. No. 09/144,607, filed Aug. 31, 1998, catalytic materials are described for use in the catalytic cracking process which are capable of reducing the sulfur content of the liquid products of the cracking process. These sulfur reduction catalysts comprise, in addition to a porous molecular sieve component, a metal in an oxidation state above zero within the interior of the pore structure of the sieve. The molecular sieve is in most cases a zeolite and it may be a zeolite having characteristics consistent with the large pore zeolites such as zeolite beta or zeolite USY or with the intermediate pore size zeolites such as ZSM-5. Non-zeolitic molecular sieves such as MeAPO-5, MeAPSO-5, as well as the mesoporous crystalline materials such as MCM-41 may be used as the sieve component of the catalyst. Metals such as vanadium, zinc, iron, cobalt, and gallium were found to be effective for the reduction of sulfur in the gasoline, with vanadium being the preferred metal. When used as a separate particle additive catalyst, these materials are used in combination with an active catalytic cracking catalyst (normally a faujasite such as zeolite Y and REY, especially as zeolite USY and REUSY) to process hydrocarbon feedstocks in the fluid catalytic cracking (FCC) unit to produce low-sulfur products. Since the sieve component of the sulfur reduction catalyst may itself be an active cracking catalyst, for instance, zeolite Y, REY, USY, and REUSY, it is also possible to use the sulfur reduction catalyst in the form of an integrated cracking/sulfur reduction catalyst system, for example, comprising USY as the active cracking component and the sieve component of the sulfur reduction system together with added matrix material such as silica, clay and the metal, e.g. vanadium, which provides the sulfur reduction functionality.

In application Ser. Nos. 09/221,539 and 09/221,540, both filed Dec. 28, 1998, sulfur reduction catalysts similar to the ones described in application Ser. No. 09/144,607 were described, however, the catalyst compositions in those applications also comprise at least one rare earth metal component (e.g. lanthanum) and a cerium component, respectively.

SUMMARY OF THE INVENTION

An improved catalytic cracking process has now been developed which is capable of improving the reduction in the sulfur content of the liquid products of the cracking process, including the gasoline and middle distillate cracking fractions. The present process employs sulfur reduction catalysts similar to the ones described in application Ser. Nos. 09/144,607, 09/221,539 and 09/221,540, each of which is incorporated herein by reference in their entirety, in that the cracking catalyst employed in the present invention contains a product sulfur reducing component containing a metal component in an oxidation state greater than zero, with preference being given to vanadium. Preferably, the sulfur reduction component will include a molecular sieve containing the metal component within the interior of the pore structure of the sieve. The improvement, according to the present invention includes a step of increasing the average oxidation state of the metal component after the catalyst has been regenerated. It has been found that by increasing the oxidation state of the metal component, there is an increase in the sulfur reduction activity of the catalyst.

The present invention may employ sulfur reduction catalysts which are in the form of a gasoline sulfur reduction (GSR) additive in combination with an active cracking catalyst in the cracking unit, that is, in combination with the conventional major component of the circulating cracking catalyst inventory which is usually a matrixed, zeolite containing catalyst based on a faujasite zeolite, usually zeolite Y, REY, USY and REUSY. Alternatively, the catalyst may be in the form of an integrated cracking/product sulfur reduction catalyst system.

The sulfur reduction component can comprise a porous molecular sieve which contains a metal in an oxidation state above zero within the interior of the pore structure of the sieve. The sulfur reduction component can also comprise a metal in an oxidation state above zero dispersed anywhere on the catalyst support structure, including porous oxide supports. The molecular sieve, when used, is in most cases a zeolite and it may be a zeolite having characteristics consistent with the large pore zeolites such as zeolite beta or zeolite USY or with the intermediate pore size zeolites such as ZSM-5. Non-zeolitic molecular sieves such as MeAPO-5, MeAPSO-5, as well as the mesoporous crystalline materials such as MCM-41 may be used as the sieve component of the catalyst. Metals such as vanadium, zinc, iron, cobalt, manganese and gallium are effective. If the selected sieve material has sufficient cracking activity, it may be used as the active catalytic cracking catalyst component (normally a faujasite such as zeolite Y) or, alternatively, it may be used in addition to the active cracking component, whether or not it has any cracking activity itself.

In one embodiment, at least a portion of the catalyst inventory having the product sulfur reducing component is exposed to oxidative treatment by contact with an oxygen containing gas, which treatment is in addition to the treatment employed in regenerating the cracking catalyst. Preferably, the additional oxidative treatment is carried out under conditions sufficient to substantially fully oxidize the metal component of the sulfur reducing component.

In another embodiment, in which the sulfur reducing component is in the form of a separate GSR additive to the active cracking catalyst, an oxidation device is used to separate the GSR additive from the regenerated cracking catalyst and to selectively oxidize the GSR additive, prior to returning both the oxidized GSR additive and the regenerated cracking catalyst to the catalytic cracking zone (e.g. the riser) of the FCC unit.

DETAILED DESCRIPTION OF THE INVENTION

In accordance with the present invention, an improved catalytic cracking process is provided for reducing the sulfur content of the liquid products produced from a hydrocarbon feed containing organosulfur compounds. The present process employs a catalyst system having a sulfur reduction component containing a metal component in an oxidation state greater than zero. The sulfur reduction activity of the catalyst system is increased by increasing the oxidation state of the metal component prior to introducing the catalyst system into the catalytic cracking zone.

FCC Process

Apart from the process changes in accordance with the present invention, as discussed below, the manner of operating the process will generally be consistent with a conventional FCC process. Thus in an embodiment of the present invention, conventional FCC cracking catalysts may be employed, for example, zeolite based catalysts with a faujasite cracking component as described in the seminal review by Venuto and Habib, *Fluid Catalytic Cracking with Zeolite Catalysts*, Marcel Dekker, New York 1979, ISBN 0-8247-6870-1 as well as in numerous other sources such as Sadeghbeigi, *Fluid Catalytic Cracking Handbook*, Gulf Publ. Co. Houston, 1995, ISBN 0-88415-290-1.

Generally, in a conventional fluid catalytic cracking process the heavy hydrocarbon feed containing the organosulfur compounds will be cracked to lighter products by contacting the feed in a cyclic catalyst recirculation cracking process with a circulating fluidizable catalytic cracking catalyst inventory consisting of particles having a size ranging from about 20 to about 100 microns. The significant steps in such a cyclic process are:

(i) the feed is catalytically cracked in a catalytic cracking zone, normally a riser cracking zone, operating at catalytic cracking conditions by contacting feed with a source of hot, regenerated cracking catalyst (hereinafter referred to as an equilibrium catalyst or "E-Cat") to produce an effluent comprising cracked products and spent catalyst containing coke and strippable hydrocarbons;

(ii) the effluent is discharged and separated, normally in one or more cyclones, into a vapor phase rich in cracked product and a solids rich phase comprising the spent catalyst;

(iii) the vapor phase is removed as product and fractionated in the FCC main column and its associated side columns to form liquid cracking products including gasoline, (iv) the spent catalyst is stripped, usually with steam, to remove occluded hydrocarbons from the catalyst, after which the stripped catalyst is oxidatively regenerated to produce E-Cat which is then recycled to the cracking zone for cracking further quantities of feed.

In addition to the conventional FCC process, discussed above, the present invention employs a catalyst having a sulfur reduction component containing a metal component in an oxidation state greater than zero and includes a step for increasing the average oxidation state of the metal component after the catalyst is regenerated, and prior to recycling the catalyst to the cracking zone.

In an embodiment of the present invention, the step for increasing the average oxidation state of the metal component comprises exposing at least a portion of the catalyst containing the sulfur reduction component to additional oxidative treatment by contacting the catalyst with an oxygen containing gas. The conditions for the additional oxidative treatment include an $O_2$ partial pressure in the range of about 1 to 20 psia, preferably about 8 to 16 psia; a total system pressure of about 20 to 100 psia, preferably about 40 to 70 psia; a catalyst residence time of about 1 to 60 minutes, preferable about 1 to 10 minutes; and a temperature in the range from about 1100 to 1550° F., preferably about 1200 to 1450° F.

Preferably, the catalyst will be exposed to additional oxidative treatment under conditions sufficient to substantially fully oxidize the metal component, i.e. raise the oxidation state of the metal cation to its highest level.

FCC Cracking Catalyst

The present invention can employ a sulfur reduction component in the form of a separate particle additive (GSR additive) which is added to the main cracking catalyst (E-Cat) in the FCCU or, alternatively, may be a component of the cracking catalyst to provide an integrated cracking/sulfur reduction catalyst system. The cracking component of the catalyst which is conventionally present to effect the desired cracking reactions and the production of lower boiling cracking products, is normally based on a faujasite zeolite active cracking component, which is conventionally zeolite Y in one of its forms such as calcined rare-earth exchanged type Y zeolite (CREY), the preparation of which is disclosed in U.S. Pat. No. 3,402,996, ultrastable type Y zeolite (USY) as disclosed in U.S. Pat. No. 3,293,192, as well as various partially exchanged type Y zeolites as disclosed in U.S. Pat. Nos. 3,607,043 and 3,676,368. Cracking catalysts such as these are widely available in large quantities from various commercial suppliers. The active cracking component is routinely combined with a matrix material such as silica or alumina as well as a clay in order to provide the desired mechanical characteristics (attrition resistance etc.) as well as activity control for the very active zeolite component or components. The particle size of the cracking catalyst is typically in the range of about 10 to 100 microns for effective fluidization.

Sulfur Reduction System—Sieve Component

The sulfur reduction component will preferably comprise a porous molecular sieve which contains a metal in an oxidation state above zero within the interior of the pore structure of the sieve. The molecular sieve is in most cases a zeolite and it may be a zeolite having characteristics consistent with the large pore zeolites such as zeolite Y, preferably zeolite USY, or zeolite beta or with the intermediate pore size zeolites such as ZSM-5, with the former class being preferred.

The molecular sieve component of the present sulfur reduction catalysts may, as noted above, be a zeolite or a non-zeolitic molecular sieve. When used, zeolites may be selected from the large pore size zeolites or intermediate pore zeolites (see *Shape Selective Catalysis in Industrial Applications*, Chen et al, Marcel Dekker Inc., New York 1989, ISBN 0-8247-7856-1, for a discussion of zeolite classifications by pore size according to the basic scheme set out by Frilette et al in *J. Catalysis* 67, 218–222 (1981)). The small pore size zeolites such as zeolite A and erionite, besides having insufficient stability for use in the catalytic cracking process, will generally not be preferred because of their molecular size exclusion properties which will tend to exclude the components of the cracking feed as well as many components of the cracked products. The pore size of the sieve does not, however, appear to be critical since, as shown below, both medium and large pore size zeolites have been found to be effective, as have the mesoporous crystalline materials such as MCM-41.

Zeolites having properties consistent with the existence of a large pore (12 carbon ring) structure which may be used to make the present sulfur reduction catalysts include zeolites Y in its various forms such as Y, REY, CREY, USY, of which the last is preferred, as well as other zeolites such as zeolite L, zeolite beta, mordenite including de-aluminated mordenite, and zeolite ZSM-18. Generally, the large pore size zeolites are characterized by a pore structure with a ring opening of at least 0.7 nm and the medium or intermediate pore size zeolites will have a pore opening smaller than 0.7 nm but larger than about 0.56 nm. Suitable medium pore size zeolites which may be used include the pentasil zeolites such as ZSM-5, ZSM-22, ZSM-23, ZSM-35, ZSM-50, ZSM-57, MCM-22, MCM-49, MCM-56 all of which are known materials. Zeolites may be used with framework metal elements other than aluminum, for example, boron, gallium, iron, or chromium.

The use of zeolite USY is particularly desirable since this zeolite is typically used as the active cracking component of the cracking, catalyst and it is therefore possible to use the sulfur reduction catalyst in the form of an integrated cracking/sulfur reduction catalyst system. The USY zeolite used for the cracking component may also, to advantage, be used as the sieve component for a separate particle additive catalyst as it will continue to contribute to the cracking activity of the overall catalyst present in the unit. Stability is correlated with low unit cell size (UCS) with USY and, for optimum results, the UCS for the USY zeolite in the finished catalyst should be from about 2.420 to 2.458 nm, preferably about 2.420 to 2.445 nm, with the range of 2.435 to 2.440 nm being very suitable. After exposure to the repeated steaming of the FCC cycles, further reductions in UCS will take place to a final value which is normally within the range of about 2.420 to 2.430 nm.

In addition to the zeolites, other molecular sieves may be used although they may not be as favorable since it appears that some acidic activity (conventionally measured by the alpha value) is required for optimum performance. Experimental data indicate that alpha values in excess of about 10 (sieve without metal content) are suitable for adequate desulfurization activity, with alpha values in the range of 0.2 to 2,000 being normally suitable[1]. Alpha values from 0.2 to 300 represent the normal range of acidic activity for these materials when used as additives.

[1] The alpha test is a convenient method of measuring the overall acidity, inclusive of both its internal and external acidity, of a solid material such as a molecular sieve. The test is described in U.S. Pat. No. 3,354,078; in the Journal of Catalysis, Vol. 4, p. 527 (1965); Vol. 6, p. 278 (1966); and Vol. 61, p. 395 (1980). Alpha values reported in this specification are measured at a constant temperature of 538° C.

Exemplary non-zeolitic sieve materials which may provide suitable support components for the metal component of the present sulfur reduction catalysts include silicates (such as the metallosilicates and titanosilicates) of varying silica-alumina ratios, metalloaluminates (such as germaniumaluminates), metallophosphates, aluminophosphates such as the silico- and metalloaluminophosphates referred to as metal integrated aluminophosphates (MeAPO and ELAPO), metal integrated silicoaluminophosphates (MeAPSO and ELAPSO), silicoaluminophosphates (SAPO), gallogermanates and combinations of these.

Another class of crystalline support materials which may be used is the group of mesoporous crystalline materials exemplified by the MCM-41 and MCM-48 materials. These mesoporous crystalline materials are described in U.S. Pat. Nos. 5,098,684; 5,102,643; and 5,198,203.

Amorphous and paracrystalline support materials are also contemplated, such as amorphous refractory inorganic oxides of Group 2, 4, 13 and 14 elements, for example, $Al_2O_3$, $SiO_2$, $ZrO_2$, $TiO_2$, MgO and mixtures thereof, and paracrystalline materials such as the transitional aluminas.

Metal Components

The metal component contained in the sulfur reduction component of the catalysts useful in the present invention include those metals disclosed in application Ser. Nos. 09/144,607, 09/221,539 and 09/221,540, each of which is incorporated herein by reference. Although any metal cation which exhibits sulfur reduction activity is contemplated, the metal or metals should not exhibit significant hydrogenation activity, because of the concern for excessive coke and hydrogen production during the cracking process. For this reason, the noble metals such as platinum and palladium which possess strong hydrogenation-dehydrogenation functionality are not desirable. Base metals and combinations of base metals with strong hydrogenation functionality such as nickel, molybdenum, nickel-tungsten, cobalt-molybdenum and nickel-molybdenum are not desirable for the same reason. The preferred base metals are the metal values of Period 4 Groups 5, 7, 8, 9, 12 and 13 (IUPAC classification, previously Groups IIB, VB, VIIB and VIIIB) of the Periodic Table. Vanadium, zinc, iron, cobalt, manganese and gallium are effective with vanadium being the preferred metal component. Preferably, the base metal, e.g. vanadium, will be contained within the interior of the pore structure of the porous molecular sieve. It is believed that the location of the vanadium inside the pore structure of the sieve immobilizes the vanadium and prevents it from becoming vanadic acid species which can combine deleteriously with the sieve component; in any event, the present zeolite-based sulfur reduction catalysts containing vanadium as the metal component have undergone repeated cycling between reductive and oxidative/steaming conditions representative of the FCC cycle while retaining the characteristic zeolite structure, indicating a different environment for the metal.

Vanadium is particularly suitable for gasoline sulfur reduction when supported on zeolite USY. The yield structure of the V/USY sulfur reduction catalyst is particularly interesting. While other zeolites, after metals addition, demonstrate gasoline sulfur reduction, they tend to convert gasoline to $C_3$ and $C_4$ gas. Even though much of the converted $C_3^=$ and $C_4^=$ can be alkylated and re-blended back to the gasoline pool, the high $C_4^-$ wet gas yield may be a concern since many refineries are limited by their wet gas compressor capacity. The metal-containing USY has similar yield structure to current FCC catalysts; this advantage would allow the V/USY zeolite content in a catalyst blend to be adjusted to a target desulfurization level without limitation from FCC unit constraints. The vanadium on Y zeolite catalyst, with the zeolite represented by USY, is therefore a particularly favorable combination for gasoline sulfur reduction in FCC. The USY which has been found to give particularly good results is a USY with low unit cell size in the range from about 2.420 to 2.458 nm, preferably about 2.420 to 2.445 nm (following treatment) and a correspondingly low alpha value. Combinations of base metals such as vanadium/zinc as the primary sulfur reduction component may also be favorable in terms of overall sulfur reduction.

The amount of metal in the sulfur reduction component is normally from 0.1 to 10 weight percent, typically 0.15 to 5 weight percent, (as metal, relative to weight of sieve component) but amounts outside this range, for example, up to 10 weight percent may still be found to give some sulfur removal effect. When the sieve is matrixed, the amount of the primary sulfur reduction metal component expressed relative to the total weight of the catalyst composition will, for practical purposes of formulation, typically extend from 0.05 to 5, more typically from 0.05 to 3 weight percent of the entire catalyst. A second metal may be added to the sulfur reduction component, e.g. cerium, which is present within the pore structure of the molecular sieve, as described in application Ser. No. 09/221,540.

When the catalyst is being formulated as an integrated catalyst system, it is preferred to use the active cracking component of the catalyst as the sieve component of the sulfur reduction system, preferably zeolite USY, both for simplicity of manufacture but also for retention of controlled cracking properties. It is, however, possible to incorporate another active cracking sieve material such as zeolite ZSM-5 into an integrated catalyst system and such systems may be useful when the properties of the second active sieve material are desired, for instance, the properties of ZSM-5. The impregnation/exchange process should in both cases be carried out with a controlled amount of metal so that the requisite number of sites are left on the sieve to catalyze the cracking reactions which may be desired from the active cracking component or any secondary cracking components which are present, e.g. ZSM-5.

Use of Separate Additive as Sulfur Reduction Component

Preferably, the sulfur reduction catalyst will be as a separate particle additive (GSR additive) to the catalyst inventory. In its preferred form, with zeolite USY as the sieve component, the addition of the GSR additive to the total catalyst inventory of the unit will not result in significant reduction in overall cracking because of the cracking activity of the USY zeolite. The same is true when another active cracking material is used as the sieve component. When used in this way, the composition may be used in the form of the pure sieve crystal, pelleted (without matrix but with added metal components) to the correct size for FCC use. Normally, however, the metal-containing sieve will be matrixed in order to achieve adequate particle attrition resistance and to maintain satisfactory fluidization. Conventional cracking catalyst matrix materials such as alumina or silica-alumina, usually with added clay, will be suitable for this purpose. The amount of matrix relative to the sieve will normally be from 20:80 to 80:20 by weight. Conventional matrixing techniques may be used.

Use of a GSR additive permits the ratio of sulfur reduction and cracking catalyst components to be optimized according to the amount of sulfur in the feed and the desired degree of desulfurization; when used in this manner, it is typically used in an amount from about 1 to 50 weight percent of the entire catalyst inventory in the FCCU; in most cases the amount will be from about 5 to 25 weight percent, e.g. 5 to 15 weight percent. About 10 percent represents a norm for most practical purposes. The GSR additive remains active for sulfur removal for extended periods of time although very high sulfur feeds may result in loss of sulfur removal activity in shorter times.

Other catalytically active components may be present in the circulating inventory of catalytic material in addition to the cracking catalyst and the sulfur removal additive. Examples of such other materials include the octane enhancing catalysts based on zeolite ZSM-5, CO combustion promoters based on a supported noble metal such as platinum, stack gas desulfurization additives such as DESOX™ (magnesium aluminum spinel), vanadium traps and bottom cracking additives, such as those described in Krishna, Sadeghbeigi, op cit. and Scherzer, *Octane Enhancing Zeolitic FCC Catalysts*, Marcel Dekker, New York, 1990, ISBN 0-8247-8399-9. These other components may be used in their conventional amounts.

The effect of the present GSR additives is to reduce the sulfur content of the liquid cracking products, especially the light and heavy gasoline fractions although reductions are also noted in the light cycle oil, making this more suitable for use as a diesel or home heating oil blend component. The sulfur removed by the use of the catalyst is converted to inorganic form and released as hydrogen sulfide which can be recovered in the normal way in the product recovery section of the FCCU in the same way as the hydrogen sulfide conventionally released in the cracking process. The increased load of hydrogen sulfide may impose additional sour gas/water treatment requirements but with the significant reductions in gasoline sulfur achieved, these are not likely to be considered limitative.

In one embodiment, the GSR additive particles are preferred to have a higher density or a larger average particle size than the E-Cat particles. This can be accomplished by using a heavier binder (e.g. heavier clay) for the GSR additive than for the E-Cat or by using a GSR additive with a larger average particle size (APS) than the E-Cat, for example, a GSR additive having an APS of about 100 $\mu$m and a cracking catalyst having an APS of about 70 $\mu$m.

The heavier or larger particles of the GSR additives will allow them to have a relatively longer residence time in the bottom of the regenerator where the $O_2$ partial pressure is higher. This longer residence time can help the regenerator to burn the coke off the GSR additives and to selectively expose these additives to additional oxidative treatment than is typical for a regenerated catalyst. Preferably, the particle density and/or size can be optimized to increase the residence time in the bottom of the regenerator to fully oxidize the metal component of the additive.

In another embodiment, additional air or oxygen can be introduced at various points in a conventional FCC process to provide additional oxidative treatment for the GSR additives. For example, the air or oxygen can be introduced into the regenerator standpipe or the standpipe withdrawal cone to continue to oxidize the GSR additive and E-Cat. Additional air or oxygen can also be added to the second stage of a two-stage regenerator to increase the $O_2$ partial pressure sufficiently to increase the average oxidation state of the metal component of the GSR additive.

In yet another embodiment, the process equipment from a conventional FCC process can be modified or new devices added, in conjunction with adding additional air or oxygen to the system. For example, the regenerator standpipe or standpipe cone can be modified to reduce catalyst fluxes or increase catalyst residence time, while subjecting the catalyst to additional oxidative treatment. In another example, the catalyst cooler can be placed after the regenerator and air or oxygen can be introduced into the catalyst cooler to continue to oxidize the regenerated catalyst before introducing the catalyst into the catalytic cracking zone.

A catalytic cracking process which is particularly well suited for employing a catalyst system which includes a GSR additive according to the improved process of the present invention utilizes a separate oxidizing device, illustrated in accompanying FIG. 1. It should be noted that the oxidizing device depicted in FIG. 1 is intended to be merely exemplary. Although the use of such a device is a preferred embodiment, the present invention can be practiced by any conventional fluidized catalytic cracking unit which is capable of increasing the average oxidation state of the metal component of the catalyst system prior to introduction into the catalytic cracking zone.

Referring now to FIG. 1, the separate oxidizing device 1 comprises a oxidation zone 2 and a freeboard zone 3. Depending on the regenerated FCC catalysts that flow into this vessel through the inlet tube 4 (e.g., the residue carbon, the V level etc.) and their required oxidation conditions (e.g., the catalyst flux and residence time, the air flow rate and its partial pressure, etc.) the size of device 1 can vary from about 5 to 80% of the size of the main regenerator, preferably about 5 to 20% of the size of the main regenerator. The height to diameter ratio of the device 1 can vary from about 1 to 20, preferably about 3 to 7.

The device 1 works in the following manner: the regenerated FCC catalyst blend containing about 0 to 50% of GSR additives, preferably about 0 to 30% of additives, with certain residue carbon on it flow into the device 1 from the bottom of the main regenerator through the catalyst inlet 4. The GSR additives will have a larger average particle size and/or have a higher density than the E-Cat particles. Preferably, the GSR additive particles will have an APS greater than 90 $\mu$m and the E-Cat particles will have an APS less than 90 $\mu$m. Optionally, a GSR additive rich stream can be separated from the regenerated FCC catalyst blend and only the GSR additive rich stream will be introduced into the device 1. The preheated air enters this device through an air distributor plate 5. In order to maintain the oxidization zone fluidized bed 2 in a suspended and viable state, the superficial gas velocity (SGV) of the air flow through the device generally exceeds the minimum flow rate required for fluidization which is typically from about 0.2 ft/s (0.61 m/s) to 0.5 ft/s (0.153 m/s). Preferably, a high SGV should be maintained at not less than about 1.0 ft/s (0.306 m/s). The high airflow will entrain most of the small E-Cat particles (<90 $\mu$m) back to the regenerator immediately through outlet 6. The un-used oxygen will be continually utilized to burn the coke in the regenerator. In addition, the high air flow rate will ensure that the partial pressure of oxygen in the oxidation zone 2 is high enough to burn all the coke off the catalyst and provide an oxidizing environment to completely oxidize the metal on the bigger size additive particles (>90 $\mu$m). The SGV should preferably not exceed about 10.0 ft/s (3.0 m/s), more preferably not more than about 5.0 ft/s (1.5 m/s). The completely oxidized GSR additives rich catalyst 7 will flow back to the bottom of the standpipe of the regenerator and mix with the main stream of the regenerated catalyst 8 through the catalyst outlet tube 9. The flux of this catalyst stream 7 will be in the range of about 1 to 50% of the flux of the main regenerated catalyst stream 8; preferably around 10% of the main flux 8.

EXAMPLES

The following examples have been carried out for the purpose of illustration and to describe embodiments of the best mode of the invention at the present time. The scope of the invention is not in any way limited by the examples set forth below. These examples include the preparation of a vanadium containing zeolite Beta sulfur reduction additive, the preparation of a vanadium containing zeolite USY sulfur reduction additive and evaluations of the performance of the catalysts as sulfur reduction additives.

Example 1

A V/Beta/Silica-Alumina-Clay catalyst, Catalyst A, was prepared using a commercial $NH_4$-form Beta with a silica-to-alumina ratio of 35. The $NH_4$-form Beta was calcined under $N_2$ at 900° F. (482° C.) for 3 hours, then under air at 1000° F. (534° C.) for 6 hours to produce an H-form Beta. The resulting H-form Beta was ion-exchanged with $V^{4+}$ by an exchange with a 1M $VOSO_4$ aqueous solution. The exchanged Beta was further washed, dried, and air calcined. The resulting V/Beta contained 1.3 wt % V. The V/Beta was then combined with a matrix in fluid form by preparing an aqueous slurry containing the V/Beta crystals and a silica/alumina-gel/clay matrix. The slurry was thereafter spray dried to form a catalyst containing about 40 wt % V/Beta crystals, 25 wt % silica, 5 wt % alumina, and 30 wt % Kaolin clay. The spray-dried catalyst was calcined at 1000° F. (534° C.) for 3 hours. The final catalyst contained 0.56 wt % V.

The formed catalyst, Catalyst A, was then steam deactivated, to simulate catalyst deactivation in an FCC unit, by subjecting the catalyst to Cyclic Propylene Steaming (CPS) in a fluidized bed steamer at 1420° F. (771° C.) for 20 hours using 50 vol % steam and 50 vol % gas. The CPS process consisted of changing the gas every ten minutes, in the following cycle: $N_2$, propylene and $N_2$ mixture, $N_2$, and air, to simulate the coking/regeneration cycle of an FCC unit (cyclic steaming). Two sample batches of deactivated catalyst were collected: the first batch containing the catalyst where the CPS cycle ended with an air-burn (ending-oxidation) and the second batch containing the catalyst where the CPS cycle ended with a propylene charge (ending-reduction). The coke content of the "ending-reduction" catalyst was less than 0.05 wt % C. The physical properties of the calcined and steam deactivated catalysts are summarized in Table 1 below.

Example 2

A V/USY/Silica-Clay Catalyst, Catalyst B, was prepared using a low-unit-cell-size USY, having an average Unit Cell Size (UCS) of 24.35 Å and a bulk silica-to-alumina ratio of 5.4. The as received USY was combined with a silica-sol/clay matrix in fluid form by forming a slurry in a similar manner to Example 1. The resulting slurry was spray dried to form a catalyst containing about 50 wt % USY crystals, 20 wt % silica and 30 wt % kaolin clay. The spray-dried catalyst was ammonium-exchanged using ammonium sulfate to remove $Na^+$ and then calcined in air at 1000° F. Vanadium was added by incipient wetness impregnation with a vanadyl oxalate solution to target 0.5 wt % V on the final catalyst. The resulting V/USY catalyst was then air calcined. The final catalyst contained 0.52 wt % V.

The catalyst was steam deactivated via CPS in a fluidized bed steamer at 1420° F. for 20 hours using 50 vol % steam and 50 vol % gas. Two sample batches of deactivated catalyst were collected: the first batch containing steam deactivated catalyst via ending-oxidation and the second batch containing catalyst via ending-reduction. The coke content of the ending-reduction catalyst is less than 0.05 wt % C. The physical properties of the calcined and steam deactivated catalysts are summarized in Table 1 below.

Catalysts A and B were blended, respectively, with a low metal equilibrium catalyst (E-Cat), to evaluate their performance as sulfur reducing additives. The physical properties of the E-Cat are listed in Table 1 below.

TABLE 1

Physical Properties of Catalysts

| | Low Metal E-Cat as-received | V/Beta Catalyst | V/USY Catalyst |
|---|---|---|---|
| Fresh Cat. | | | |
| V, wt % | <0.1 | 0.56 | 0.52 |
| Na, wt % | 0.21 | 0.08 | 0.10 |
| $SiO_2$, wt % | 63.7 | 74.8 | 74.1 |
| $Al_2O_3$, wt % | 31.7 | 19.4 | 23.7 |
| $RE_2O_3$, wt % | 2.6 | <0.1 | <0.1 |
| Ash, wt % | 99.4 | 97.9 | 96.4 |
| UCS, A | N.A. | N.A. | 24.35 |
| Surface area, $m^2/g$ | 180 | 325 | 327 |
| Steam Deactivated Cat. | | | |
| Surface area, $m^2/g$ | N.A. | ~170 | 239 |
| UCS, A | N.A. | N.A. | 24.24 |

Example 3

The two sample batches of steam-deactivated V/Beta catalysts from Example 1 were evaluated as gasoline S reduction additives. The sample batches, i.e. the ending-oxidation batch and the ending-reduction batch, were blended with the E-Cat to form blends containing 10 wt % additives, respectively. The equilibrium catalyst used had very low metal levels (i.e. 120 ppm V and 60 ppm Ni).

The additives were tested for gas oil cracking activity and selectivity using an ASTM microactivity test (ASTM procedure D-3907) with a vacuum gas oil (VGO) feed stock. The VGO properties are shown in Table 2 below.

TABLE 2

Properties of Vacuum Gas Oil Feed

| | Vacuum Gas Oil |
|---|---|
| Charge Stock Properties | |
| API Gravity | 26.6 |
| Aniline Point, ° F. | 182 |
| CCR, wt % | 0.23 |
| Sulfur, wt % | 1.05 |
| Nitrogen, ppm | 600 |
| Basic nitrogen, ppm | 310 |
| Ni, ppm | 0.32 |
| V, ppm | 0.68 |
| Fe, ppm | 9.15 |
| Cu, ppm | 0.05 |
| Na, ppm | 2.93 |
| Distillation | |
| IBP, ° F. | 358 |
| 50 wt %, ° F. | 716 |
| 99.5%, ° F. | 1130 |

The E-Cat was tested alone, prior to testing the catalyst with the sample additives from Example 1, to establish a product base level. Each catalyst (i.e. E-Cat alone, E-Cat/10 wt % V/Beta (ending-reduction) and E-Cat/10 wt % V/Beta (ending-oxidation)) was tested over a range of conversion by varying the catalyst-to-oil ratio, while maintaining a constant temperature of about 980° F. (527° C.). Gasoline, LCO and HFO yields were determined using simulated distillation data (SimDis, ASTM Method D2887) of syncrude samples. The gasoline range product from each material balance was analyzed with a GC (AED) to determine the gasoline S concentration. To reduce experimental errors in S concentration associated with fluctuations in the distillation cut point of gasoline, the S species ranging from thiophene to C4-thiophenes in syncrude (excluding benzothiophene and higher boiling S species) were quantified and the sum defined as "cut-gasoline S."

Performances of the catalysts are summarized in Table 3, where the product selectivity for each catalyst was interpolated to a constant conversion of 70 wt % conversion of feed to the gasoline range product (i.e. product boiling below 430° F. (221° C.)).

TABLE 3

Catalytic Cracking Performance of V/Beta Additive Catalyst in Oxidized and Reduced Environments

| MAT Product Yields | Base E-Cat Case | +10% V/Beta Catalyst A. ending-reduction | Base E-Cat Case | +10% V/Beta Catalyst A. ending-oxidation |
|---|---|---|---|---|
| Conversion, wt % | 70 | 70 | 70 | 70 |
| Cat/Oil | 3.3 | 3.4 | 3.2 | 3.2 |
| $H_2$ yield, wt % | 0.05 | +0.02 | 0.03 | +0.06 |
| $C_1 + C_2$ Gas, wt % | 1.4 | +0 | 1.4 | +0 |
| Total $C_3$ Gas, wt % | 5.4 | +0.1 | 5.4 | +0 |
| $C_4^+$ yield, wt % | 4.6 | +0 | 4.5 | +0 |
| Total $C_4$ Gas, wt % | 10.7 | +0.3 | 10.9 | +0.1 |
| $C_4^+$ yield, wt % | 5.4 | +0.3 | 5.5 | +0.2 |
| $IC_4$ yield, wt % | 4.6 | +0 | 4.6 | −0.1 |
| $C_5^+$ Gasoline, wt % | 49.6 | −0.3 | 49.5 | −0.3 |
| LFO, wt % | 25.6 | +0.2 | 25.7 | +0 |
| HFO, wt % | 4.4 | −0.2 | 4.3 | +0 |
| Coke, wt % | 2.7 | +0.03 | 2.6 | +0.2 |
| Cut Gasoline S, PPM | 459 | 423 | 482 | 336 |
| Reduction in Cut Gasoline S, % | Base | 7.8 | Base | 30.3 |
| % Reduction in Gasoline S, Feed Basis | Base | 8.4 | Base | 30.8 |

A review of Table 3 reveals that Catalyst A is very effective in reducing gasoline S level. When 10 wt % of Catalyst A (4 wt % Beta zeolite addition) was blended with the E-Cat, 8% and 30% reduction in gasoline sulfur concentration was achieved depending on the oxidation state of the gasoline S reduction additive. Also, the V/Beta catalysts showed only moderate increases in $H_2$ and coke yields.

Example 4

The two sample batches of steam-deactivated V/USY catalysts from Example 2 were evaluated as gasoline S reduction additives. The sample batches were blended with the E-Cat to form blends containing 25 wt % of each batch, respectively. The additives were tested with the VGO feed and under similar conditions to Example 3. The performances of these catalysts are summarized in Table 4 below.

TABLE 4

Catalytic Cracking Performance of V/USY Additive Catalyst in Oxidized and Reduced Environments

| MAT Product Yields | Base E-Cat Case | +25% V/USY Catalyst B. ending-reduction | +25% V/USY Catalyst B. ending-oxidation |
|---|---|---|---|
| Conversion, wt % | 70 | 70 | 70 |
| Cat/Oil | 2.9 | 3.4 | 3.7 |
| $H_2$ yield, wt % | 0.03 | +0 | +0.10 |
| $C_1 + C_2$ Gas, wt % | 1.5 | +0 | +0.2 |
| Total $C_3$ Gas, wt % | 5.6 | +0 | +0.9 |
| $C_3$ = yield, wt % | 4.7 | +0 | +0.7 |

TABLE 4-continued

Catalytic Cracking Performance of V/USY Additive Catalyst in Oxidized and Reduced Environments

| MAT Product Yields | Base E-Cat Case | +25% V/USY Catalyst B. ending-reduction | +25% V/USY Catalyst B. ending-oxidation |
|---|---|---|---|
| Total $C_4$ Gas, wt % | 11.3 | −0.1 | +0.6 |
| $C_4$ = yield, wt % | 5.8 | +0.2 | +0.5 |
| $IC_4$ yield, wt % | 4.7 | −0.3 | +0.1 |
| $C_5^+$ Gasoline, wt % | 49.0 | +0.1 | −2.4 |
| LFO, wt % | 25.5 | +0.2 | −0.1 |
| HFO, wt % | 4.5 | −0.3 | +0.1 |
| Coke, wt % | 2.4 | −0.1 | +0.4 |
| Cut Gasoline S, PPM | 517 | 484 | 267 |
| Reduction in Cut Gasoline S, % | Base | 6.4 | 48.3 |
| % Reduction in Gasoline S, Feed Basis | Base | 6.3 | 50.8 |

A review of Table 4 reveals that Catalyst B is very effective in reducing the gasoline S level. When 25 wt % of Catalyst B (10 wt % V/USY zeolite addition) was blended with the E-Cat, 6% and 48% reduction in gasoline sulfur concentration was achieved depending on the oxidation state of the GSR additive. The V/USY catalysts showed only moderate increases in $H_2$ and coke yields.

A review of both Tables 3 and 4 reveals that the catalysts with 10% V/Beta and 25% V/USY ending-oxidation are much more effective in gasoline sulfur reduction than the ones ending-reduction (31% vs. 8%, and 48% vs. 6% in cut gasoline sulfur reduction). This indicates that the V works much more effectively in gasoline sulfur reduction when it is in its oxidized state $V^{5+}$. In their reduced form, V-containing catalysts are less effective for gasoline sulfur reduction.

We claim:

1. In a catalytic cracking process for cracking a hydrocarbon feed containing organosulfur compounds in the presence of a hot regenerated cracking catalyst, said process having a standpipe and/or standpipe cone located between a regenerator and a riser and said catalyst having a product sulfur reduction component comprising a matrix of alumina or silica-alumina with clay and containing a cracking component comprising a zeolite which contains within its interior pore structure a metal component comprising vanadium in an oxidation state greater than zero, the improvement which comprises:

increasing the average oxidation state of said metal component of said regenerated cracking catalyst by subjecting regenerated catalyst to oxidative treatment during passage of the regenerated catalyst through the standpipe and/or standpipe cone, or during passage through a device connected to the standpipe or standpipe cone.

2. The process of claim 1, wherein said zeolite is selected from the group consisting of Y, REY, USY, REUSY, Beta and ZSM-5.

3. The process of claim 1, wherein said product sulfur reduction component is a separate particle additive catalyst which has an average particle size greater than the average particle size of the cracking catalyst.

4. In a catalytic cracking process for cracking a hydrocarbon feed containing organosulfur compounds in the presence of a hot regenerated cracking catalyst, said catalyst having a product sulfur reduction component comprising a matrix of alumina or silica-alumina with clay and containing a cracking component comprising a zeolite which contains within its interior pore structure a metal component comprising vanadium in an oxidation state greater than zero, the improvement which comprises:

providing a product sulfur reduction component which is a separate particle additive catalyst which has an average particle size greater than the average particle size of the cracking catalyst;

regenerating both the cracking catalyst and the additive catalyst by contact with oxygen containing gas to produce a regenerated catalyst mixture;

separating from the regenerated catalyst mixture a concentrated cracking catalyst stream comprising the regenerated cracking catalyst and a concentrated additive catalyst stream comprising the regenerated additive catalyst;

exposing the concentrated additive catalyst stream to additional oxidative treatment by contact with oxygen containing gas to produce an oxidized additive catalyst stream; and recycling the oxidized additive catalyst stream to the catalytic cracking process.

5. The process of claim 3, wherein said additive catalyst is about 1 to about 50 weight percent of the total catalyst inventory.

6. The process of claim 4, wherein the average oxidation state of said metal component is increased by exposing said sulfur reduction component to additional oxidative treatment by contact with oxygen containing gas having an $O_2$ partial pressure in the range from about 8 to 16 psia, at a temperature in the range of about 1100° F. to 1550° F. and a residence time in the range of about 1 to 60 minutes.

7. The process of claim 6, wherein said additional oxidative treatment is carried out under conditions to substantially fully oxidize the metal component.

* * * * *